United States Patent [19]

Burgener

[11] 4,288,994

[45] Sep. 15, 1981

[54] GOLFBALL CENTER FREEZER

[75] Inventor: David B. Burgener, Lombard, Ill.

[73] Assignee: Chemetron Corporation, Chicago, Ill.

[21] Appl. No.: 179,379

[22] Filed: Aug. 18, 1980

[51] Int. Cl.[3] ..... F25D 25/02

[52] U.S. Cl. ..... 62/381; 62/63; 62/384

[58] Field of Search ..... 62/63, 64, 374, 375, 62/381, 384

[56] References Cited

U.S. PATENT DOCUMENTS

| | | | |
|---|---|---|---|
| 1,892,224 | 12/1932 | Sorber | 62/381 |
| 1,969,104 | 8/1934 | Sibley et al. | 62/381 |
| 2,284,270 | 5/1942 | Eberts et al. | 62/381 |
| 2,318,736 | 5/1943 | Birdseye | 62/381 |
| 2,456,124 | 12/1948 | Hoffman | 62/63 |
| 2,697,463 | 12/1954 | Desrosier | 62/63 |
| 3,089,316 | 5/1963 | Robbins | 62/381 |
| 3,906,743 | 9/1975 | Schorsch et al. | 62/381 |

FOREIGN PATENT DOCUMENTS

| | | | |
|---|---|---|---|
| 1278602 | 6/1972 | United Kingdom | 62/381 |

*Primary Examiner*—Ronald C. Capossela
*Attorney, Agent, or Firm*—John K. Williamson

[57] ABSTRACT

A rotary freezer for cooling resilient golfball centers to a uniform, substantially rigid state is provided with a dispenser to permit dispensing of rigid centers in one-at-a-time fashion from a large batch of frozen centers in the freezer at a rate indepenent of the residence time. As the freezer drum rotates, paddles on the inner circumference serve to lift randomly-selected centers from the batch to a predetermined height for gravity loading onto an inclined rack forming a part of the dispenser. Centers on the rack are arranged in a rectilinear series leading to an outlet port where a metering assembly controls dispensing of the centers from the drum in one-at-a-time fashion at a rate determined by the operator. A gravity conveyor exterior of the freezer drum transports each dispensed center from the outlet to a work station where the winding process is to be initiated before the center returns to its resilient state. In preferred forms, the freezer has a pair of dispensers, each with its own conveyor whereby two winding stations may be served. The freezer is designed to use liquid $CO_2$ as a refrigerant for more efficient operation.

15 Claims, 5 Drawing Figures

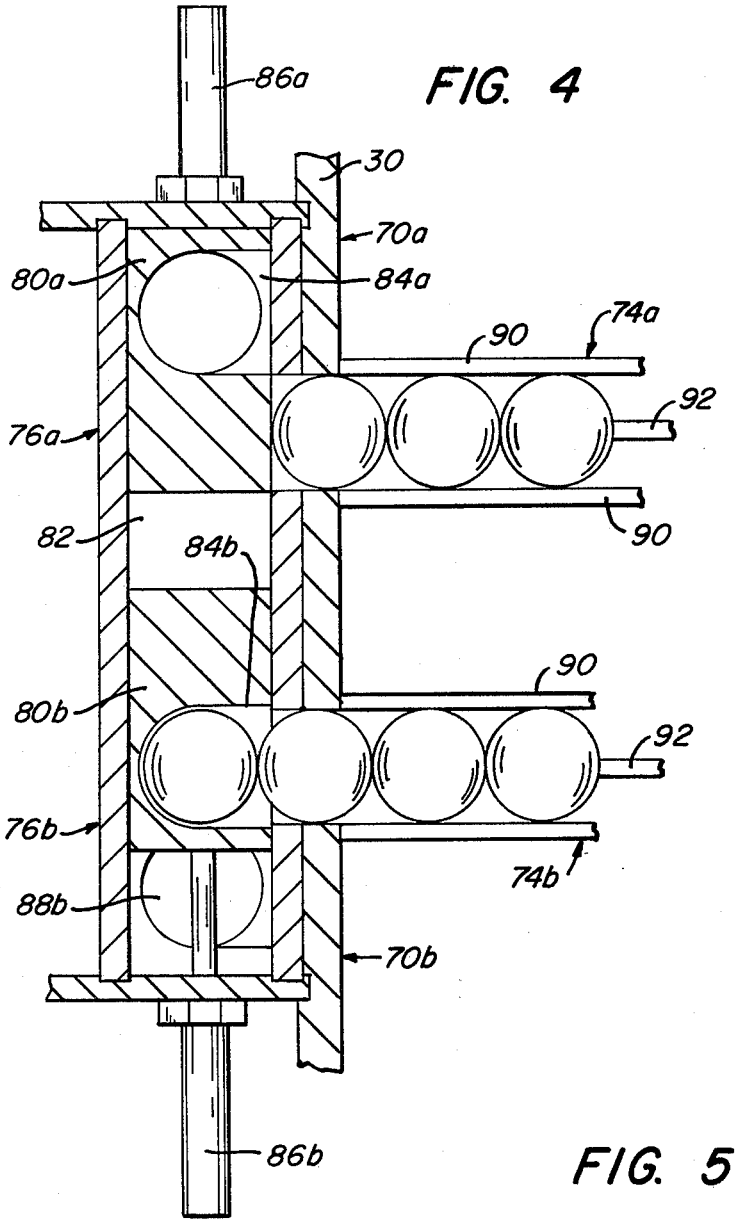
FIG. 4
FIG. 5
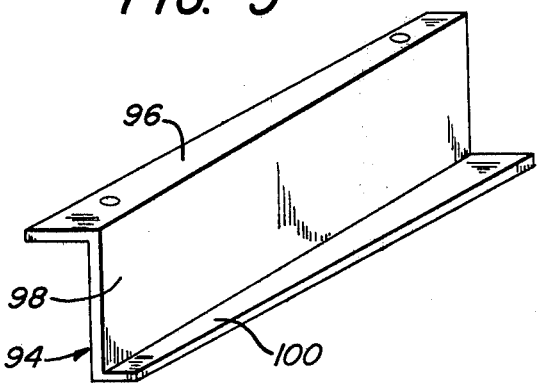

GOLFBALL CENTER FREEZER

TECHNICAL FIELD

This invention relates to refrigeration equipment generally, and is particularly concerned with a rotary freezer adapted for cooling resilient golfball centers to a uniform rigid state and for dispensing the frozen centers one-at-a-time to a work station upon operator command.

BACKGROUND ART

In the manufacture of golfballs, it has long been the practice to form a highly elastic composite inner core by winding a rubber strand under tension about a small, resilient, spherical center. Since the spherical centers control to a large degree the shape and balance of the finished golfball core, and hence the performance characteristics of the final product, care must be exercised to ensure that the center is not deformed during the manufacturing process. This is a particularly difficult task during the initial stages of the winding operation inasmuch as the initial turns of the elastic thread tend to locally compress the resilient center.

In order to overcome the foregoing problem, it is a well known practice in golfball fabrication to freeze the resilient centers immediately prior to winding such that they are in a substantially rigid state and resist the compressive forces imparted by the elastic thread. While this technique has virtually eliminated deformation of the resilient centers during the winding operation, other problems are created with its implementation. Specifically, the process of freezing the golfball centers is cumbersome, expensive, and time consuming. Moreover, handling of the frozen centers also presents difficult problems because the centers must typically be delivered to the winding machine operators singularly and in a substantially uniform state of rigidity.

Presently, most golfball manufacturers freeze the resilient centers at a central location and manually dispense small batches in a refrigerated package to the winding stations where the individual operators remove the centers from the refrigerated package as they are needed. Typically, the centralized cooling station utilizes solid $CO_2$ (dry ice) or liquid nitrogen as a refrigerant. Manifestly, this method of operation is highly inefficient and has several other drawbacks as well. For example, the centers dispensed in this manner may have a coating of frost formed on them due to excessive exposure to humid air in the manufacturing plant. Additionally, the centers may be exposed to widely varying temperature conditions such that centers from batch-to-batch or within a single batch may not necessarily have the same degree of rigidity. This latter problem can, in extreme instances, cause undesirable variations in the performance characteristics of the finished golfballs.

One attempt to provide a machine which overcomes the foregoing problems is disclosed in Sibley et al., U.S. Pat. No. 1,969,104. There, golfball centers are stored in a large hopper and passed through a refrigeration zone along a spiral track to a dispensing station where the centers are presented to an operator upon command in one-at-a-time fashion. However, the Sibley device has several serious deficiencies which have prevented its acceptance by golfball manufacturers. First, spiral-type tracks have been found to be inherently unreliable in the movement of resilient golfball centers. The nature of these centers is such that they do not readily roll along tortuous paths, as has been found by others attempting to solve the problem of dispensing golfball centers in one-at-a-time fashion. Secondly, the residence time of the golfball centers in the Sibley device is directly dependent upon the rate at which the centers are dispensed. Accordingly, the degree of rigidity of the centers dispensed from the freezer may vary as demand for the centers varies. The refrigeration zone of the Sibley device never reaches an equilibrium state unless the operator discontinues demand for centers for an undetermined period of time. Further, the Sibley device is not suited for applications where liquid-core centers are utilized since it has been found that a tumbling action must be imparted to such centers during freezing in order to ensure that any air bubbles in the liquid are centrally disposed.

DESCRIPTION OF THE INVENTION

In the present invention, a rotary freezer simultaneously tumbles and freezes a large batch of golfball centers and is provided with a dispenser for delivering centers one-at-a-time to a winding station upon operator command. After a predetermined cool-down time, an equilibrium state is reached within the rotary freezer such that each center dispensed therefrom exhibits substantially the same state of rigidity.

The freezer utilizes liquid $CO_2$ as a refrigerant, and a temperature probe controls release of $CO_2$ into the freezer such that there is maintained a desired equilibrium within the freezer.

Paddles on the inner circumference of the rotating freezer drum function to load centers in the freezer onto a pair of inclined, generally axially extending ball racks each leading to a respective outlet through the endwall of the freezer. A metering device is provided for each outlet to effect one-at-a-time dispensing of the centers through the respective outlets upon operator command. Gravity-type conveyors serve to deliver the dispensed centers from the outlets to a pair of work stations each attended by a winding operator.

BRIEF DESCRIPTION OF THE DRAWINGS

FIG. 4 is a cross-sectional view taken along line 4—4 of FIG. 3; and FIG. 5 is a perspective view of a center-loading paddle.

DETAILED DESCRIPTION OF THE PREFERRED EMBODIMENT

Figure 1:
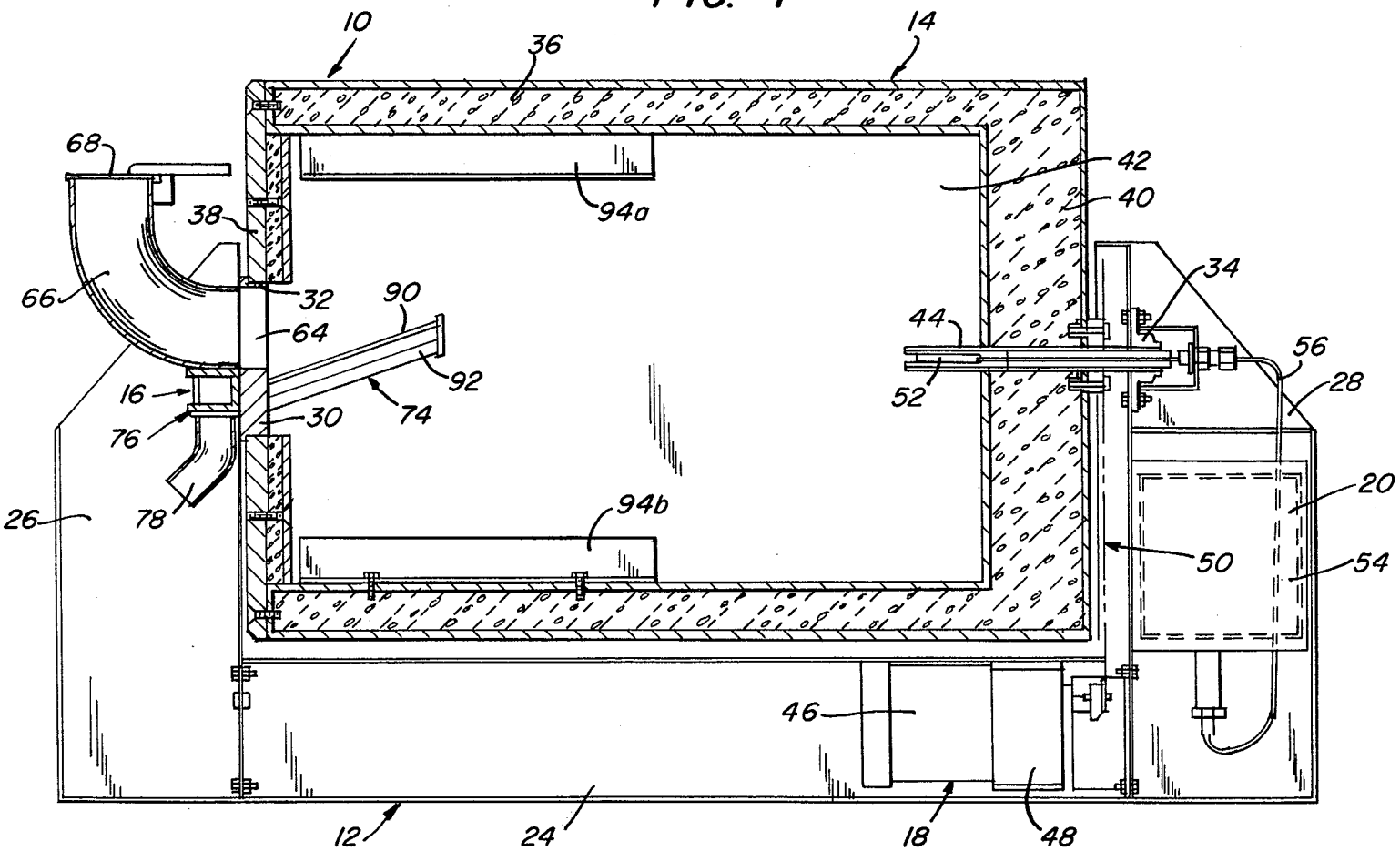
FIG. 1 is an axial cross-sectional view of a rotary freezer constructed in accordance with the principles of the present invention.

In FIG. 1 there is shown a golfball center freezer 10 comprising a stationary frame 12, a cylindrical, insulated hollow drum 14 rotatably mounted on frame 12 for rotation about a horizontal axis, a dispenser 16 for controlling egress of ball centers from the freezer 10, and a power train 18 operably coupled with the drum 14 for powered rotation of the latter. A temperature control 20 in communication with the interior of the drum 14 cooperates with a refrigeration assembly 22 (shown only in FIG. 3) to maintain the interior of the drum 14 at a preselected temperature as may be required to provide the desired degree of rigidity to the golfball centers. The frame 12 comprises a lowermost, generally horizontally disposed base 24 and a pair of upright stanchions 26, 28 at opposite ends of the base 24. An upright, circular hub plate 30 is rigidly secured to the stanchion 26 and has a stepped annular shoulder 32 which forms a bearing for rotatably supporting one end of the drum 14 to the frame 12. A bearing 34 secured to the opposite stanchion 28 in axial alignment with the hub plate 30 rotatably secures the opposite end of the drum 14 to the frame 12 in a manner to be described.

The drum 14 has a circular sidewall 36 and a pair of opposed endwalls 38, 40, defining a substantially sealed inner chamber 42. The walls 36, 38, and 40 are of conventional sandwich construction each having an inner and outer shell formed of synthetic resin based fiberglass, and an intermediate layer of polyurethane foam insulation therebetween.

Bolts or similar releasable attachment means are provided for the endwall 38 such that it is removable from the drum 14 to provide access into the chamber 42. Though not shown, more convenient access to the chamber 42 may be allowed by the provision of a sealable door mounted in the sidewall 36.

As shown for example in FIG. 1, the endwall 38 complementally engages the shoulder 32 on hub plate 30 to complete the bearing support for the discharge end of the drum 14. A hollow axle 44 extending centrally through the endwall 40 and rigidly attached thereto projects outwardly therefrom in cooperable engagement with the drive end bearing 34.

Considering now the power train 18 as shown in FIG. 1, there is included a drive motor 46 which is mechanically coupled to the endwall 40 of the drum 14 through a gear reducer 48 and a chain and sprocket assembly 50. The drive motor 46 rotates the drum 14 in a clockwise direction, as viewed in FIG. 2, at a relatively slow speed. In preferred forms, the drum 14 is rotated at approximately 6 RPM, though variable speed capability may be provided.

The temperature control 20 comprises a temperature sensing probe 52 disposed in the chamber 42 within the innermost end of the hollow axle 44, and an electrical temperature controller 54 coupled with the probe 52 via conductor 56. The controller 54 is of conventional construction and functions to control the actuation of refrigeration of assembly 22 to maintain the temperature of chamber 42 within a desired range. The controller 54 may be preprogrammed at the election of the operator such that the temperature within the chamber 42 may be varied as desired to produce the required degree of rigidity in the golfball centers.

Figure 3:
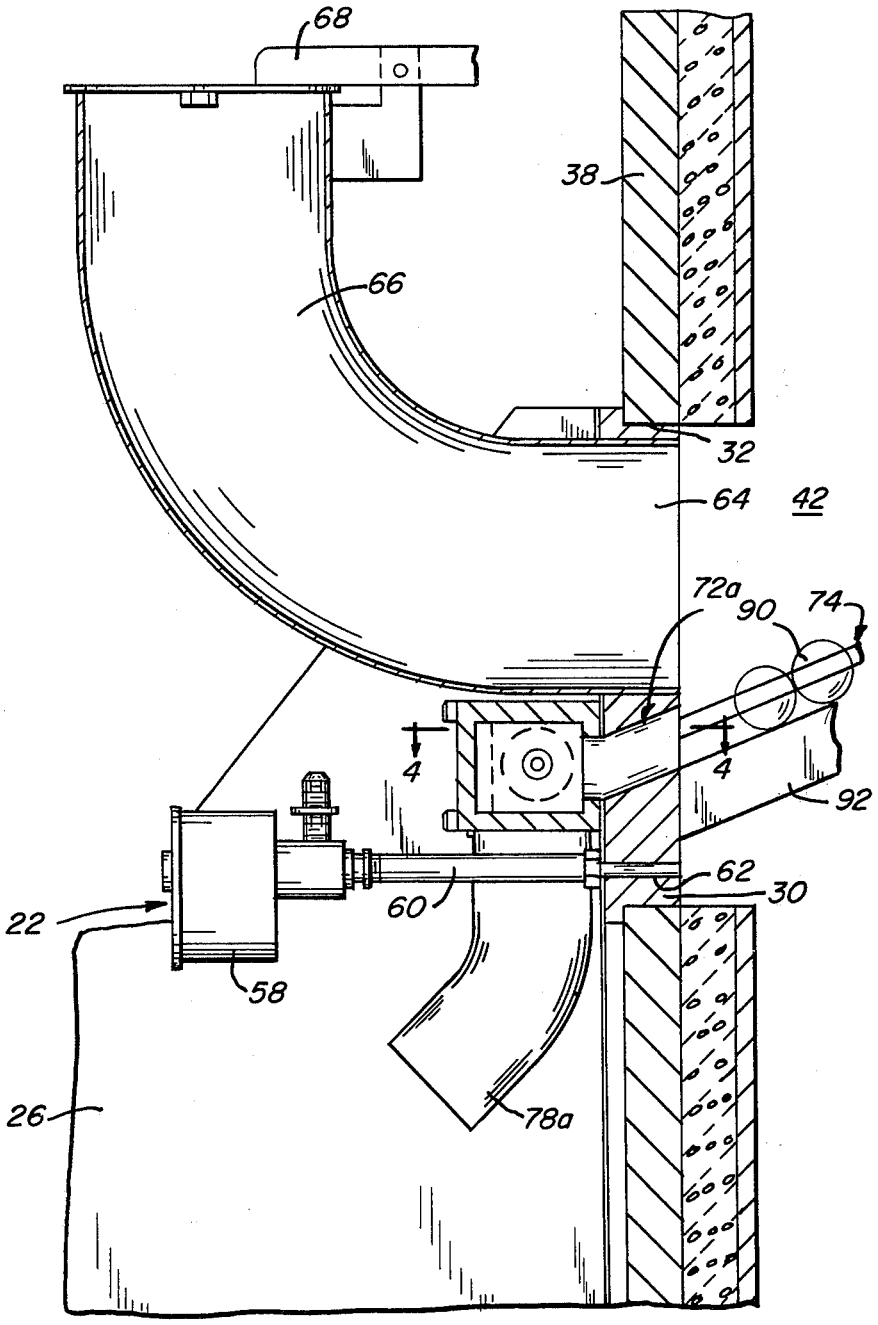
FIG. 3 is a fragmentary enlarged cross-sectional view as in FIG. 1, illustrating in further detail the dispenser end of the freezer.

As best shown in FIG. 3, the refrigeration assembly 22 comprises a solenoid valve 58 adapted to be coupled with a source of liquid $CO_2$ (not shown) under a nominal pressure of 300 psig, and a conduit 60 extending from the discharge side of the valve 58 to an inlet 62 through the plate 30 to establish fluid communication with the chamber 42. Valve 58 is of the type conventionally used for $CO_2$ expansion and discharges the 300 psig liquid $CO_2$ at a rate of approximately 3 pounds per minute. Actuation of the valve 58 is determined by the temperature control 20 in accordance with the temperature conditions inside the chamber 42 as measured by the temperature sensing probe 52. When the temperature in the chamber 42 goes above a preselected minimum value, the valve 58 discharges liquid $CO_2$ into the conduit 60 where there is formed solid dry ice and $CO_2$ vapors which are carried through the inlet 62 into the chamber 42 for cooling of the golfball centers therein. The dry ice in the chamber 42 sublimes to lower the internal temperature and the vapors are exhausted by natural flow as will be described. It has been found that dry ice will not build up inside the freezer as long as the temperature in the chamber is greater than −90° F. By appropriate substitution for the valve 58, liquid nitrogen may also be used as a refrigerant, but operating expenses would be substantially greater.

An exhaust port 64 is formed in the hub plate 30 to permit venting of $CO_2$ vapors from the chamber 42 and is in sealed communication with an exterior elbow pipe 66 which directs the vented vapors away from the freezer 10. A damper 68 on the outermost end of the pipe 66 precludes undesired entry of ambient temperature air into the chamber 42 during normal operation of the freezer 10. The damper 68 may be manually opened such that the exhaust port 64 may also function as a fill port when it is desired to load the drum 14 with a batch of ball centers for freezing.

Figure 2:
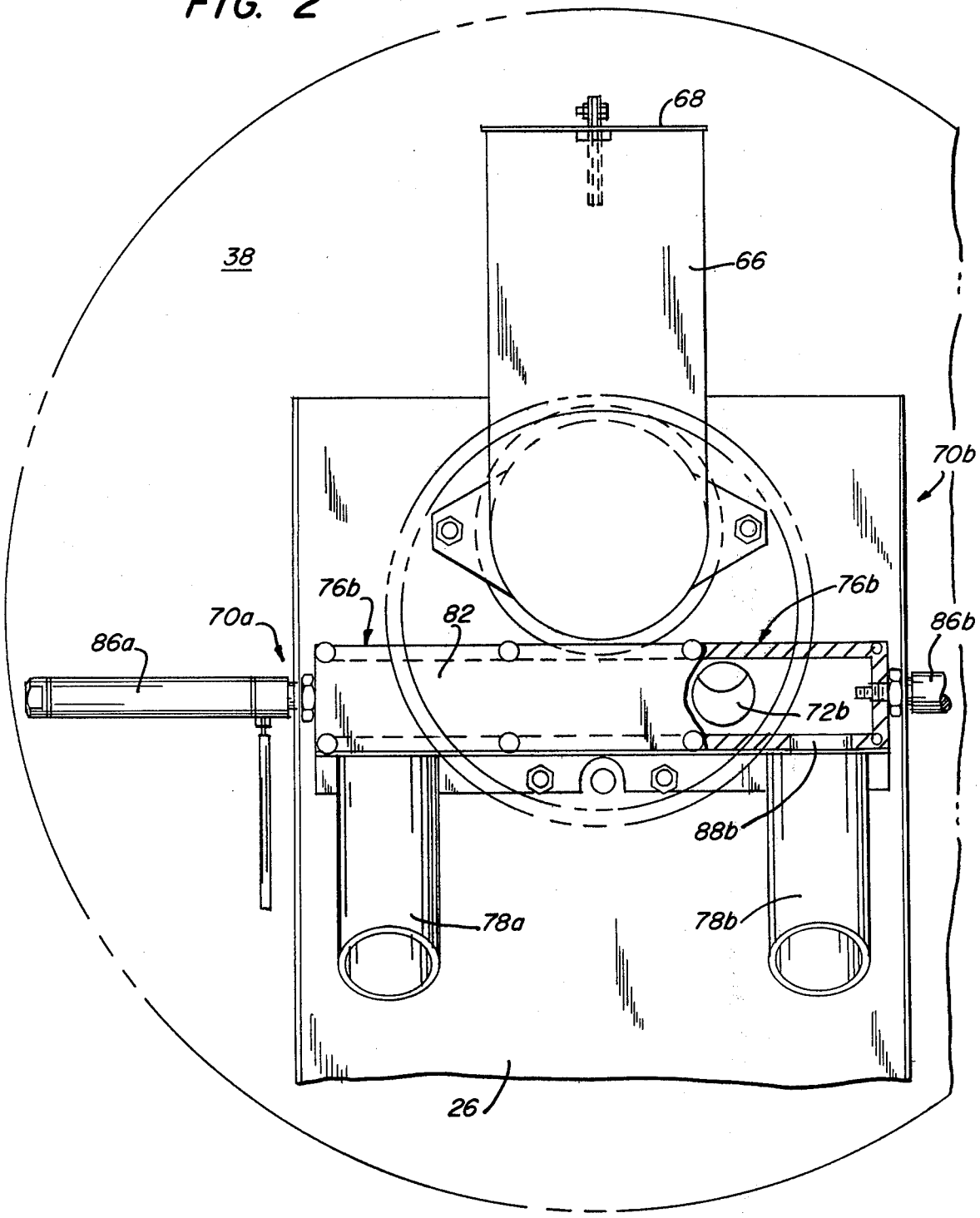
FIG. 2 is a fragmentary end view showing the dispenser end of the freezer.

As illustrated in FIGS. 2 and 4, the dispenser 16 comprises a pair of dispensing sections 70*a*, *b*, each independent of the other and each capable of discharging ball centers from the chamber 42 in one-at-a-time fashion. Since the sections 70*a*, 70*b* are substantially identical in construction and operation, only the section 70*a* will be described in detail, it being understood that 70*b* is an identical mirror image of the section 70*a*.

The dispensing section 70*a* comprises an outlet 72 formed through the hub plate 30 beneath the exhaust port 64, an elongate, ball-supporting rack mounted within the chamber 42 on the plate 30 for directing ball centers to the outlet 72, a metering mechanism 76 for permitting ball centers on the rack 74 to pass through the outlet 72 in one-at-a-time fashion, and a gravity conveyor 78 for transporting ball centers from the mechanism 76 to a winding station (not shown).

The mechanism 76 comprises a slide block 80 adapted to reciprocate along a horizontal, rectilinear track formed by an elongate, tubular channel 82 mounted on the stanchion 26 with its longitudinal axis extending generally transversely of the axis of the drum 14. As shown in FIG. 4, the slide block 80 has a ball-receiving slot 84 formed therein particularly configured to receive a single ball center from the outlet 72. In preferred forms, the depth of the slot 84 is slightly greater than the diameter of the ball centers so that the second ball in the series is contacted by the block 80 as it retracts from the outlet 72. In this manner, ball centers carried on the rack 74 are constantly jostled by the reciprocating block 80 to prevent jamming of the centers on the rack. A spring-return pneumatic cylinder assembly 86 reciprocates the slide block 80 between a ball receiving position wherein the slot 84 is aligned with the outlet 72 (as shown for the dispensing section 70*b* in FIG. 4) and a ball discharge position wherein the slot 84 is vertically aligned over a discharge aperture 88 formed in the bottom wall of the channel 82 (as shown for dispensing section 70*a* in FIG. 4).

It will be appreciated that a single ball center will be discharged through aperture 88 with each stroke of the cylinder 86. The cylinder 86 is selectively actuated by a conventional manual control (not shown) to permit the winding operator to order ball centers from the freezer 10 as desired. Alternatively, the control for the cylinder 86 may be automatic to provide discharge of the ball centers at a preselected rate. The gravity conveyor 78 communicates with the discharge aperture 88 such that discharged ball centers are fed by gravity through the conveyor to a desired location.

As shown in FIG. 4, the slide blocks 80 of each mechanism 76 are of sufficient length to fully close the respective outlets 72*a* and 72*b* when the blocks 80 are shifted to their ball discharge positions. By this arrangement, the blocks 80 function as airlocks for the outlets 72 such that undesired water ice buildup is precluded.

The ball supporting rack 74 inside the chamber 42 comprises a pair of elongate, parallel, laterally offset side rails 90, and a bottom rail 92 beneath the rails 90 extending parallel thereto in a plane passing between the rails 90 approximately equidistant therefrom. As shown in FIG. 3, the rack 74 is inclined upwardly away from the outlet 72 such that the ball centers carried on the rack 74 are fed by gravity to the outlet. It has been determined that this angle of incline must be at least 20° and that it should not exceed 60°. The length of the rack 74 should be such that it supports 6 to 8 ball centers in a linear series leading to the outlet 72.

An important feature of the present invention is the manner in which ball centers in the chamber 42 are loaded onto the rack 74 for subsequent discharge through the outlet 72. To this end, there are provided paddles 94*a*, 94*b* (each for a respective dispensing section 70*a*, 70*b*) on the inner circumference of the drum 14 as shown, for example, in FIG. 1. As shown in FIG. 5, the paddles 94 are elongate and present a generally z-shaped cross-section with an uppermost mounting flange 96 adapted to abut against the sidewall 36 within the drum 14, a rib section 98 which extends generally radially of the drum 14 when the paddle 94 is mounted thereupon, and a center-engaging lip 100 adapted to be carried in offset, tangentially extending relation to the sidewall 36 of the drum 14. In operation, the rib section 98 and lip 100 randomly engage centers in the chamber 42, and as the drum rotates, carry a number of the centers upwardly to a predetermined release point where the centers fall onto the ball support rack 74. The precise desired release point is dependent upon the rotation speed of the drum 14 and the relative position of the rack 74.

It will be appreciated that the actual release point for a given rotation speed is determined by the dimension of lip 100. Generally, the narrower the lip 100, the sooner will be the release point along the arcuate path of travel of the paddle 94. In any event, the release point must be calculated such that the ball centers fall along a trajectory which is intercepted by the rack 74.

Two additional factors must be considered in determining the exact dimension of the lip 100. First, since the rack 74 is inclined, it will intercept different trajectories at different locations axially of the drum 14. To compensate for this, the lip 100 must be tapered such that it is progressively narrower as the endwall 38 is approached. The second consideration is that the lip 100 on paddles 94*a* must be differently dimensioned than the corresponding lip on the paddle 94*b* inasmuch as the ball support racks 74 for the respective dispensing sections 70*a*, 70*b* are at different locations transversely of the drum 14. Hence, the width of the lip 100 on the paddle 94*b* must be significantly greater than the corresponding lip on the paddle 94*a*. In preferred forms, it is desired to provide two paddles 94 for each ball support rack 74 in order to assure that the racks 74 are always sufficiently loaded. The circumferential spacing for the paddles 94 associated with a particular rack 74 may be as desired, but a spacing of 90° has proved suitable. Additionally, the lateral spacing between the inside side rails 90*a* and 90*b* of racks 74*a* and 74*b* should be greater than the diameter of the ball centers to preclude jamming of the centers between the racks.

INDUSTRIAL APPLICABILITY

As explained, the golfball center freezer 10 is particularly designed for use in the manufacture of golfballs. It is believed that the present invention offers significant advantages not available heretofore.

At the start of a production run, the operator of the freezer 10 simply fills the drum 14 with a batch of golfball centers of sufficient number to supply two winding operators for a full 8-hour shift. When the filled freezer 10 is actuated, the drum 14 will be slowly rotated by power train 18 to tumble the ball centers carried therewithin, while simultaneously the refrigeration assembly 22 will be actuated by the temperature control 20 to cool the chamber 42. This concurrent cooling and tumbling continues until the ball centers in the drum 14 have been sufficient cooled to reach a uniform desired state of rigidity.

The operator then actuates cylinder assembly 86 to obtain a single ball center from the freezer 10. In actual practice, the first few balls in a production run will be discarded because these centers have rested adjacent the outlet 72 and may not have the same degree of rigidity as the other ball centers in the drum 14. However, once these initial centers have been discarded, the operator orders a frozen center from the freezer 10 and begins the winding process on his winding machine (not shown). The operator continues to receive single frozen ball centers from the drum 14 in response to his requirements throughout the 8-hour working shift.

Each center the operator receives is in the same state of rigidity as the previously received centers regardless of the rate at which he orders centers from the freezer for winding. Thus, the uniformity of the finished golfballs may be improved.

The freezer 10 offers a relatively simple and inexpensive solution to a problem which has long plagued the golfball manufacturing industry. Centers from the freezer 10 are delivered in a uniform state of rigidity one-at-a-time upon operator command. Thus, labor requirements are reduced, while at the same time the quality of the final product is enhanced.

What I claim is:

1. A freezer for cooling normally resilient spherical objects to a substantially rigid state and for selectively delivering the objects in the rigid state to a work station at ambient temperature, said freezer including:

a hollow rotatable drum adapted to receive and continuously tumble a batch of said spherical objects in random order;

drive means for rotating said drum at a preselected speed;

cooling means for maintaining the interior of said drum at a predetermined subfreezing temperature calculated to provide the desired degree of rigidity to the objects within a preselected cool-down time;

a dispenser at one end of said drum, said dispenser comprising rack means within the drum for successively arranging a number of objects from the random batch into an ordered series, and an object metering mechanism for selectively dispensing singular objects from said series through a proximal endwall of the drum;

a conveyor communicating with said metering means for transporting said dispensed objects from said dispenser to said work station, whereby after said preselected cool-down time, objects in a uniform substantially rigid state may be presented one-at-a-time to the work station at a rate independent of the residence time for the objects in the freezer.

2. The freezer of claim 1 wherein said drum is cylindrical and rotates about a generally horizontal axis.

3. The freezer of claim 2 wherein the cylindrical axis of said drum coincides with said horizontal axis of rotation.

4. The freezer of claim 3, said proximal endwall including a stationary hub forming the central portion thereof, said hub having an outlet extending therethrough, said metering mechanism being operable to selectively open and close said outlet.

5. The freezer of claim 4, said rack means including an object-supporting rack leading to said outlet from an axially spaced location within the drum, said rack being rectilinear.

6. The freezer of claim 5, said rack means further including structure on the inner cylindrical wall of the drum for loading said objects onto said rack as the drum is rotated.

7. The freezer of claim 6, said structure comprising an elongate paddle mounted on said cylindrical wall and extending axially of the drum, said paddle having a radially inwardly projecting rib section for engaging said objects and carrying the latter upwardly above said rack along an arcuate path of travel when the drum is rotated.

8. The freezer of claim 7, said rib section having an innermost edge inturned in the direcion of rotation of said drum to define an object-retaining lip, said lip being dimensioned relative to said preselected rate of rotation such that said objects are released from said paddle into a free-fall trajectory intercepted by said rack.

9. The freezer of claim 8, said rack being rectilinear and inclined upwardly from said outlet.

10. The freezer of claim 9, the angle of incline of said rack being equal to or greater than 20° from horizontal.

11. The freezer of claim 9, the angle of incline of said rack being in the range from 20° to 60° from horizontal.

12. The freezer of claim 9, said lip being progressively wider as the end of the paddle remote from said outlet is approached whereby to provide adjusted trajectories for the objects at axially spaced locations along the drum as required for proper loading of the inclinded rack.

13. The freezer of claim 4, said metering mechanism including a reciprocable slide block having an object-receiving slot, said block being shiftable between a first position wherein said slot communicates with said outlet; and a second position wherein said slot communicates with said conveyor, whereby a single said object is shifted from said outlet to said conveyor upon each reciprocation of said slide block.

14. The freezer of claim 13, said dispenser including a manually manipulable control coupled with said metering mechanism for actuating said slide block to dispense a said object upon operator command.

15. The freezer of claim 13, said block being configured to close said outlet when not in said first position, whereby the block functions as an airlock for said outlet to preclude undesired water ice buildup in the freezer.

* * * * *